US006551417B1

(12) United States Patent
Rodzewich et al.

(10) Patent No.: US 6,551,417 B1
(45) Date of Patent: Apr. 22, 2003

(54) TRI-CATION ZINC PHOSPHATE CONVERSION COATING AND PROCESS OF MAKING THE SAME

(75) Inventors: Edward A. Rodzewich, Flourtown, PA (US); Bruce V. Haberle, Fogelsville, PA (US); Joseph E. Murphy, Lansdale, PA (US)

(73) Assignee: GE Betz, Inc., Trevose, PA (US)

( * ) Notice: Subject to any disclaimer, the term of this patent is extended or adjusted under 35 U.S.C. 154(b) by 0 days.

(21) Appl. No.: 09/666,365

(22) Filed: Sep. 20, 2000

(51) Int. Cl.[7] ..... C23C 22/00

(52) U.S. Cl. ..... 148/250; 148/254; 148/259; 148/261; 148/262; 106/14.12; 252/389.52; 252/389.53

(58) Field of Search ..... 148/250, 254, 148/259, 261, 262; 106/14.12; 252/389.52, 389.53

(56) References Cited

U.S. PATENT DOCUMENTS

| | | | | |
|---|---|---|---|---|
| 2,310,239 A | | 2/1943 | Jerstedt | |
| 2,456,947 A | | 12/1948 | Jerstedt | |
| 3,109,757 A | | 11/1963 | Reinhold | |
| 3,681,148 A | * | 8/1972 | Wagenknecht et al. | 148/250 |
| 4,490,185 A | | 12/1984 | Gottwald et al. | |
| 4,498,935 A | | 2/1985 | Kent et al. | |
| 4,596,607 A | | 6/1986 | Huff et al. | |
| 4,637,838 A | | 1/1987 | Rausch et al. | |
| 4,793,867 A | | 12/1988 | Charles et al. | |
| 4,838,957 A | | 6/1989 | Miyamoto et al. | |
| 4,941,930 A | | 7/1990 | Charles et al. | |
| 4,957,568 A | | 9/1990 | Endres et al. | |
| 5,000,799 A | | 3/1991 | Miyawaki | |
| 5,221,370 A | * | 6/1993 | Jo et al. | 148/250 |
| 5,238,506 A | | 8/1993 | Cape et al. | |
| 5,261,973 A | | 11/1993 | Sienkowski et al. | |
| 5,868,874 A | | 2/1999 | Rossio | |
| 6,019,858 A | | 2/2000 | Sienkowski et al. | |

FOREIGN PATENT DOCUMENTS

| | | |
|---|---|---|
| DE | 2232067 | 7/1972 |
| GB | 876250 | 8/1961 |

* cited by examiner

*Primary Examiner*—John Sheehan
*Assistant Examiner*—Andrew L. Oltmans
(74) *Attorney, Agent, or Firm*—Hoffmann & Baron, LLP

(57) ABSTRACT

Tri-cation zinc phosphate conversion coating compositions are disclosed. The compositions include a phosphate component, ions of nickel, manganese, and zinc, and a glycerophosphate component, such as disodium glycerophosphate. Coatings formed from these compositions provide improved corrosion resistance to metal substrates and provide a uniform layer for the application of paint finishes. Processes of making and using these compositions are also disclosed.

41 Claims, No Drawings

TRI-CATION ZINC PHOSPHATE CONVERSION COATING AND PROCESS OF MAKING THE SAME

FIELD OF THE INVENTION

The present invention relates to corrosion-resistant coating compositions for metal substrates, processes for making the same, and processes for imparting anti-corrosive properties to metal substrates using such compositions. More particularly, the present invention relates to a tri-cation coating compositions which include disodium glycerophosphate.

BACKGROUND OF RELATED TECHNOLOGY

It is well known to treat metallic surfaces with phosphating solutions or compositions, which, under appropriate conditions, will deposit or form upon the metallic surface a protective phosphate coating. These phosphate coatings protect the underlying metal from corrosion and are desirable as they provide excellent surfaces for the successful application of organic finishes. Such phosphate coatings typically occur as crystalline deposits to which organic finishes will bond and adhere more tenaciously than to bare metal surfaces.

These phosphating compositions can be classified generally into two categories: (a) nickel/zinc phosphate-based conversion treatment solutions used mainly for coating iron and steel articles; and (b) nickel/manganese/zinc ("tri-cation") phosphate-based conversion treatment solutions, used principally for coating iron, steel, and galvanized or zinc alloy-plated steels. The tri-cation compositions have been found superior for the purposes of paint adhesion, corrosion resistance, and resistance to alkali solubility. Particularly, nickel contributes to increasing the corrosion resistance of the metal surface after a subsequent protective surface coating is applied, while manganese contributes to increasing the alkali resistance necessary for cathodic electrodeposition of paint. Manganese also functions to improve the water resistance of organic surface coatings over the phosphate film on zinc-rich surfaces.

Further, within these two general categories of phosphate coating compositions exist "high-zinc" and "low-zinc" compositions. High-zinc phosphating compositions are typically used in treating wire and tubing and have been found to be unsuitable for use in treating metal substrates prior to the application of paint. High-zinc compositions are known to undesirably hold lubricants on a metal surface treated with such compositions and have crystal sizes which do not permit an acceptable surface for the application of paint. Processes of treating metal substrates involving low-zinc phosphating compositions (those with a zinc ion concentration from about 0.4 to about 2 g/l) have been found to be superior for treating metal surfaces prior to the application of paint. Such processes involving low-zinc compounds require the metal surface to be treated to be activated prior to treatment in order to affect increased crystal formation of the zinc phosphating compositions.

Low-zinc phosphating baths are generally characterized by a ratio by weight of phosphate ions to zinc ions which is greater than 4 and which may assume values of up to 60. Such baths have been found particularly useful for the cathodic electrocoating of car bodies. The use of low-zinc compositions in combination with an activating agent has been shown to result in uniform and continuous coatings which exhibit superior corrosion resistance. Low-zinc coating processes are described, for example, in German Patent Specification No. 2 232 067.

While low-zinc processes, in combination with the typical subsequent electrodeposited painting step, result in a clearly improved corrosion resistance, they are more sensitive to changes in process parameters and to contaminants which are introduced into the phosphating bath with the metal sheets to be coated. As a result, it has been found advantageous to carefully control the activation of the metal surface prior to coating. Particularly, it has proven to be particularly advantageous to carry out the activation in a separate process step, subsequent to cleaning and degreasing of the metal surface. This has been found to be particularly important where the metal substrate is coated in a dip-coat procedure, but is also important in spray coating and combined spraying/dip-coating procedures.

Activation of the metal surface typically occurs by use of a Titanium(IV) compound, such as those disclosed in U.S. Pat. Nos. 2,310,239 and 2,456,947, both to Jernstedt. The activation serves to increase the rate of formation of coating crystal nuclei and, hence, the number of nuclei, in the initial phase of zinc phosphating, which results in refinement of the coating layer. The porosity of the desired zinc phosphate layer is reduced because the coating crystals are closely spaced, resulting in the formation of a uniform and continuous zinc phosphate layer over the entire metal surface. Further, the low surface area weights of the resulting coatings have been proven to be beneficial as primer for paint finishes.

Titanium-based activators, however, are attended by a variety of problems, particularly when used in combination with known tri-cation coating compositions. For example, they are characterized as having short bath lives, which leads to incomplete coating formation and an increase in coating crystal size, resulting in a decrease in refinement of the coating. Further, factors such as water hardness, cleaner, phosphate salt contamination, and pH typically cause the activator to destabilize.

Additional factors are known to affect the crystal size of the coating, such as varying conditions in the coating bath as the metal is being processed. For example, in a tri-cation coating process, an increase or decrease in zinc ions and variations in ortho-phosphate and cation metal ratios can affect crystal size. These variations may result, for example, in an increase in crystal size, marked differences in coating weight between various substrates, and increased porosity of the coating as evidenced by a decrease in neutral salt spray corrosion performance and adhesion. It is particularly important when electropaints are to be applied to maintain consistently uniform phosphate coating weights between substrates in order to assure consistent paint deposition with a uniform film build and satisfactory appearance.

Various attempts have been made in the art to address the above problems, such as the use of complexing agents based on phosphonic acids, see for example, U.S. Pat. No. 4,957,568 to Endres et al. However, these efforts have met with limited success and have failed to address various factors such as pH and bath contaminants. Further, attempts have been made to address the problems of unstable activating agents by varying methods of manufacture and particle size manipulation, but these efforts have also not proved entirely acceptable.

Therefore, there exists a need for improved coating compositions which permit the uniform coating of tri-cation phosphate compositions by stabilizing and improving the bath life of activating agents. There further exists a need for such a composition which permits uniform coating under a wide and varying range of process conditions.

SUMMARY OF THE INVENTION

Accordingly, in one aspect the present invention is directed to tri-cation conversion coating compositions for metal substrates. The compositions include a phosphate component present in amounts of about 8000 to about 30,000 parts per million (ppm), and desirably about 16000 ppm; a silicon component present in amounts of about 50 to about 300 ppm, and desirably about 100 ppm; ions of nickel present in amounts of about 100 to about 1000 ppm, and desirably about 800 ppm; ions of manganese present in amounts of about 100 to about 1000 ppm, and desirably about 800 ppm; ions of zinc present in amounts of about 500 to about 2000 ppm, and desirably about 1000 ppm; and ions of fluoride present in amounts of about 100 to about 1500 ppm, and desirably about 250 ppm.

The compositions also include a glycerophosphate compound, which is desirably disodium glycerophosphate, present in amounts of about 10 to about 500 ppm, and desirably about 65 ppm. The compositions are capable of providing anti-corrosion properties to metal and substrates when applied thereto. Coatings formed from compositions of the present invention are generally formed of crystals of about 2 to about 3 microns in size, although the sizes may vary outside of this range.

In a method aspect, the present invention is directed to a method of making a coating composition for metal substrates which includes the steps of: (i) providing phosphate ions, nickel ions, zinc ions, manganese ions, and disodium glycerophosphate; and (ii) combining each of said ion components to form a mixture. The combination of these ions is desirably in amounts sufficient to form a uniform coating for metal substrates under a wide and varying range of process conditions. The method may further include the steps of providing a silicon component and ions of fluoride in making the coating composition.

In another method aspect, the present invention is directed to a method of improving the anti-corrosion properties of metal substrates which includes the steps of: (i) providing a coating composition which includes phosphate ions, nickel ions, manganese ions, zinc ions, and disodium glycerophosphate; and (ii) coating a metal or alloy substrate with the coating composition. The coating composition may also include a silicon component and ions of fluoride. The method may further include the step of activating the metal substrate with an activating agent, such as a titanium compound. The coating step may include immersing the metal substrate in the coating composition or may include spraying the coating composition onto one or more surfaces of the metal substrate.

DETAILED DESCRIPTION OF THE INVENTION

The present invention relates to phosphate conversion coating compositions which are useful for providing anti-corrosion properties to metal substrates and providing suitable surfaces for the application of paint finishes. Compositions of the present invention include low-zinc, tri-cation phosphate compositions comprised of zinc, nickel and manganese ions. They further comprise one or more glycerophosphate compounds, desirably disodium glycerophosphates, which has been found to improve the performance of a metal surface activator, such as Ti(IV), resulting in improved phosphate coatings over a wide range of processing conditions. The inventive compositions optionally further include a silicon component and fluoride ions, both of which are desirably included to promote the coating characteristics of the inventive compositions.

Tri-cation phosphate conversion coating compositions, such as those described in U.S. Pat. No. 5,238,506, incorporated by reference herein, include three cationic species, namely zinc, nickel, and manganese, which result in coatings that exhibit improved alkaline solubility characteristics, smaller crystal structure, and superior paint adhesion, as compared to high-zinc phosphate compositions composed primarily of hopeite [$Zn_3(PO_4)_2.4H_2O$].

These cationic species may be introduced into compositions of the present invention in any conventional form. The following examples are illustrative only and are not meant in any way to limit the source of the cationic species which are found in compositions of the present invention. For example, the source of the zinc cation may be zinc, zinc nitrate, zinc oxide, zinc carbonate, zinc phosphate and combinations thereof. The source of the nickel cation can be, for example, nickel carbonate, nickel nitrate, nickel phosphate and combinations thereof. The source of the manganese cation may, for example, manganese carbonate, manganese nitrate, manganese phosphate compounds, such as those stated below, and combinations thereof.

The phosphate ion content in the present invention may be in amounts sufficient to form the desired coating, desirably in the range of about 8000 to about 30,000 ppm, and more desirably about 16000 ppm. The source of phosphate ion may be any conventional compound suitable for use in the present invention which will ionize in aqueous acidic solutions to form anions such as $(PO_4)^{-3}$ from simple compounds as well as condensed phosphoric acids including salts thereof. Ionization and neutralization of the phosphate ion sources may be to any degree which renders it suitable for use in the present invention.

Examples of such compounds, without limitation, include phosphoric acid, alkali metal phosphates such as monosodium phosphate, monopotassium phosphate, disodium phosphate, divalent metal phosphates, zinc phosphate, zinc monohydrogen phosphate, zinc dihydrogen phosphate, manganese phosphate, manganese monohydrogen phosphate, manganese dihydrogen phosphate, and combinations thereof. With the use of the divalent metal phosphates, the total phosphate or total acid as well as the divalent metal should involve control of the other sources of the phosphate and divalent metal, respectively, to obtain the desired quantities of each in the bath.

Compositions of the present invention optionally and desirably include a silicon component, which may be present in amounts sufficient to form a desired coating, desirably in the range of about 50 to about 300 ppm, and more desirably about 100 ppm The source of the silicon component may be any convention compound suitable for use in the present invention. Examples of compounds which provide a silicon component include, without limitation, hydrofluorosilicic acid, silicic acid, and silicon dioxide.

Compositions of the present invention also optionally and desirably include fluoride ions, which may be present in amounts sufficient to form a desired coating, desirably in the range of about 100 to about 1500 ppm, and more desirably about 250 ppm. The source of the fluoride ions may be any convention compound suitable for use in the present invention. Examples of such compounds include, without limitation, hydrofluoric acid, hydrofluorosilicic acid, hydrofluorotitanic acid, fluoroboric acid, their metal salts and combinations thereof.

Prior to treatment of the metal surface with the tri-cation coating composition, and subsequent to the conventional step of cleaning and degreasing the metal surface, the metal surface is activated in a conventional manner, for example, by a Titanium(IV) compound. Any conventional activating agents may be used in the present invention. Where the activating agent is a titanium compound, conventional sources of titanium may be used.

Suitable sources of titanium, include, for example, titanium tetrachloride, titanium trichloride, titanium hydroxide, titanium nitride, titanium potassium oxalate, titanium carbide, titanium dioxide, titanium potassium fluoride and combinations thereof, such as described in U.S. Pat. Nos. 2,310,239 and 2,456,947, both to Jernstedt, both specifically incorporated by reference herein. Further, the activating agent may present be in a variety of forms as applied to the metal surface, such as an aqueous dispersion of polymeric Titanium(IV) phosphates, as described in U.S. Pat. No. 4,957,568 to Endres et al., specifically incorporated by reference herein.

The present invention also includes a glycerophosphate compound, which is desirably disodium glycerophosphate. While glycerophosphates are generally known to be used in high-zinc phosphate coating compositions, the use of such compounds has heretofore not been known in tri-cation, low-zinc phosphate coatings. Tri-cation compositions of the present invention are most favorably applied to a metal surface subsequent to a separate step in which the metal surface is activated. Processes involving the application of a titanium activating compound prior to application of a tri-cation phosphate composition have been found to provide improved corrosion resistance to the metal surface to which it is being applied as well as an improved base for the application of paint finishes. However, such processes involving low-zinc tri-cation compositions are attended with a variety of problems.

For example, low-zinc, tri-cation compositions used in combination with titanium-activated metal surfaces are characterized as having short bath lives, which leads to incomplete coating formation and an increase in coating crystal size, resulting in a decrease in refinement of the coating. Further, factors such as water hardness, cleaner, phosphate salt contamination, and pH typically cause the titanium activator to destabilize. Additional factors are known to affect the crystal size of the coating, such as varying conditions in the coating bath as the metal is being processed. For example, in tri-cation coating processes, an increase or decrease in zinc ions and variations in orthophosphate and cation metal ratios can affect crystal size, cause marked differences in coating weight between various substrates, and increased porosity of the coating as evidenced by a decrease in neutral salt spray corrosion performance and adhesion. These factors are particularly important when electropaints are subsequently applied to maintain consistently uniform phosphate coating weights between substrates in order to assure consistent paint deposition with a uniform film build and satisfactory appearance.

A further problem exists with the use of manganese in tri-cation coating compositions which is not found with conventional high-zinc phosphate compositions, which do not include manganese. As manganese is characterized by multiple valence states, it tends to oxidize and precipitate in valence states other than the divalent state. This results in the formation of sludge rather than coating compound in the coating bath. Accordingly, the sludge must be filtered from the bath to prevent contamination of the metal surface.

As discussed above, prior attempts to address these problems, such as the use of complexing agents based on phosphonic acids in U.S. Pat. No. 4,957,568 to Endres et al., have been met with limited success as they do not address various factors such as pH and bath contaminants. Further, attempts have been made to address the problems of unstable activating agents by varying methods of manufacture and particle size manipulation, but these efforts have been without success. The use of a glycerophosphate compound, desirably disodium glycerophosphate, in the present invention has been found to substantially overcome all of these problems, as illustrated in the Examples set forth below.

In addition to the aforementioned components, additional compounds typically present in conventional tri-cation phosphate coating compositions may be present in compositions of the present invention. Examples of such compounds include, without limitation, ions of nitrate, boron, and iron. Conventional sources of these ionic species may be used in the preparation of compositions of the present invention.

The use of disodium glycerophosphate to enhance and maintain the performance of Titanium(IV) activating agents in the present invention over a wide range of phosphating bath parameter fluctuations is signified by variations in free acid values in the coating bath. Determination of free acid content and total acid content of the coating bath is conventionally measured on a points basis, and may be carried out by known methods, such as described in Example 2 below. Conventional processes involving tri-cation coating compositions, as illustrated in Example 3 below, are only suitable for use within a very limited range of free acids. Outside of that range, the performance of the activating agent is known to deteriorate, resulting in an undesirably wide range of coating weights, thereby affecting the corrosion resistance characteristics of the substrate and rendering the coating unsuitable for the subsequent application of electrocoat paints thereto. Additionally, increased contaminant production, such as sludge, is also realized outside of these limited processes parameters.

In the present invention, a metal surface, such as iron, steel, galvanized steel, or zinc alloy-plated steel, such as those used to form automobile bodies, is surface rinsed with a weakly alkaline rinse solution and water, as is conventionally known. Subsequently, the metal surface is conditioned using a solution of, for example, colloidal titanium, which serves as a surface activator. The metal surface is then brought into contact with the phosphate conversion composition of the present invention.

The conversion coating may be applied as a base coating or undercoating before cathodic electrodeposition coating of paints and similar materials, on the surfaces of metals, particularly iron, steel, galvanized steel, or zinc-alloy coating steel (for example, hot-dip galvanized, electroplated galvanized, zinc/nickel-plated steel sheet, zinc/iron-plated steel sheet, and the like), as well as on the surfaces of articles principally constituted of such metals, for example, automobile bodies.

The inventive coatings may be applied to a metal substrate in a conventional manner. For example, they may be applied by spray treatment, dip treatment, or by a combination of such treatments. It is known that a process of dip treating and subsequent spray treating is well suited for articles having complicated shapes, such as automobile bodies. In such a process, it is advantageous to effect the spray treatment for as long a time as is possible within the limitations of the automotive production line in order to remove any sludge which adheres to the article during the dip treatment stage.

Having set forth examples of suitable compounds which may be present in conversion coating compositions of the present invention, specific examples of compositions which were formulated and tested will now be set forth in detail below.

EXAMPLE 1

Preparation of Inventive Composition A

A phosphating bath solution in accordance with the present invention (Composition A), shown in Table 1, was prepared by diluting an acidic, concentrated product and neutralizing the bath with caustic soda to the desired free acid levels shown in Examples 3–5. Free and total acidity measurements were determined as set forth in Example 2. Table 1 sets forth the ionic species present in the bath solution and their concentration in parts per million, which is the recognized equivalent as mg/liter.

TABLE 1

| Inventive Composition A | |
|---|---|
| Ion Identification | Ion Concentration (ppm) |
| F | 250 |
| $NO_3$ | 1800 |
| B | 50 |
| Fe | 7 |
| Mn | 800 |
| Ni | 800 |
| $PO_4$ | 16000 |
| Zn | 1000 |
| Si | 100 |
| DSGP[1] | 65 |

[1]Disodium Glycerophosphate

EXAMPLE 2

Free and Total Acidity Determinations

Free and total acidity determinations were conducted in a conventional manner. For free acidity, a 3 mL buret was filled and zeroed with 0.1 N NaOH. A 10 mL sample of the tri-cation bath composition was measured and poured into an Erlenmeyer flask. 50 mL of deionized water were then added to the sample and mixed. Three drops of Bromphenol Blue indicator was then added to the sample. The sample was then titrated with 0.1 N NaOH, added drop by drop while stirring constantly, until the sample turned from yellow to blue-violet. Titration continued until there was no further darkening of the blue-violet color. The number of millileters of 0.1 N NaOH used was recorded.

For total acidity, a 25 mL buret was filled and zeroed with 0.1 N NaOH. A 10 mL sample of the tri-cation bath composition was measured and poured into a flask. 50 mL of deionized water was then added to the sample and mixed. 3 drops of phenolphthalein indicator was then added to the sample. The sample was then titrated with 0.1 N NaOH, added from the buret drop by drop and stirring constantly until 1 drop turned the sample faint pink (pH 8.3). The number of milliliters of 0.1 N NaOH used was then recorded.

Both free and total acid were reported as points, calculated as milliliters of 0.1 N NaOH recorded.

EXAMPLE 3

Coating of Rolled Steel Substrates with Inventive Composition A

This Example demonstrates the effect of DSGP on crystal size of the tri-cation coating composition. Cold Rolled Steel (CRS) panels were cleaned in a conventional alkaline cleaner, rinsed and activated with Titanium(IV) salt at a concentration of 1 gram/liter. The panels were treated with Inventive Composition A as set forth in Example 1, adjusted to a free acid of 1.0 and a ratio of total acid to free acid of 15–20, for 1 minute at 120° F. The panels were then rinsed. The average crystal size of the resultant coating was measured, as illustrated in Table 2.

TABLE 2

| Effect of DSGP on Crystal Refinement In Tri-Cation Phosphating Baths on Cold Rolled Steel Substrate | |
|---|---|
| DSGP in Bath (ppm) | Average Crystal Size (microns) |
| 0 | 5–10 |
| 65 | 2–3 |
| 130 | 2–3 |
| 195 | 2–3 |
| 260 | 2–3 |
| 325 | 2–3 |

As shown in Table 2, in the absence of DSGP, the average crystal size of the coating is between 5 and 10 microns, while the presence of small amounts of DSGP (65 ppm) result in an average crystal size of 2 to 3 microns. This crystal refinement permits improved coating on the metal surface, resulting in improved corrosion properties of the metal as well as an improved substrate for the subsequent application of a paint finish. As seen in Table 2, amounts of DSGP higher than 65 ppm are not beneficial for refining crystals but did not interfere with coating formation, although the inclusion of greater amounts of DSGP would add to the cost of the product.

EXAMPLE 4

Spray Coating of Cold Rolled Steel and Hot Dipped Galvanized Metal with Inventive Composition A and Comparative Composition B Cold Rolled Steel (CRS) and Hot Dipped Galvanized (HDG) metal was coated with Inventive Composition A, as set forth in Example 1, and Comparative Composition B (a conventional tri-cation composition which did not include DSGP), adjusted for a variety of free acid points. Coating weights, crystal sizes, and qualitative measurements were taken, as shown in Table 3.

TABLE 3

Effect of DSGP on Coating Efficacy

| | Free Acid | Ratio of Total Acid to Free Acid | DSGP (ppm in bath) | Coating Weight ($mg/ft^2$) CRS | Coating Weight ($mg/ft^2$) HDG | Crystal Size (microns) CRS | Crystal Size (microns) HDG | Appearance-Coverage |
|---|---|---|---|---|---|---|---|---|
| Composition B | 0.8 | 15–20 | 0 | 230 | 350 | 2–5 | 5–10 | CRS-uniform gray, HDG-uniform dark |
| Composition B | 1.0 | 15–20 | 0 | 200 | 315 | 2–8 | 10 | SRS-uniform gray, HDG-uniform dark, crystals larger |
| Composition B | 1.2 | 15–20 | 0 | 110 | 130 | 5–25 | >10 | Sparse coating on both metals, large crystals |
| Composition B | 1.6 | 15–20 | 0 | 100 | 90 | 10–25 | >10 | Sparse coating on both metals, large crystals, and void areas |
| Composition A | 0.8 | 15–20 | 65 | 150 | 150 | 2–5 | 1–2 | CRS-uniform gray coating, HDG-uniform gray coating |
| Composition A | 1.0 | 15–20 | 65 | 161 | 150 | 2–4 | 1–2 | SRS-uniform gray coating, HDG-uniform gray coating |
| Composition A | 1.2 | 15–20 | 65 | 167 | 168 | 2–3 | 1–2 | SRS-uniform gray coating, HDG-uniform gray coating |
| Composition A | 1.6 | 15–20 | 65 | 123 | 111 | 2–3 | >10 | Sparse coating, large crystals, voids |

As shown in Table 3, the use of DSGP in the present invention increases the coating efficacy of the tri-cation phosphating process to a free acid of 1.2. This is advantageous as processing the metal at higher acidity levels improves uniformity of the metal surface by effectively removing surface contaminants, particularly oxides which can interfere with the coating process. Additionally, it provides a surface which is more effectively and easily activated by the Titanium(IV) activator.

These improved characteristics permit a narrow range of coating weights for the inventive coatings, as illustrated by Composition A in Table 3, as compared to conventional coatings, illustrated by Composition B in Table 3. Further, the improved coating uniformity which results from the present invention provides a surface which is more receptive to a uniform film build, particularly for the application of electrocoat paints where surface uniformity is critical for appearance and corrosion performance.

EXAMPLE 5

Comparison of Spray and Dipped Conventional, Inventive, and Non-DSGP Containing Tri-Cation Coatings on Cold Rolled Steel and Hot Dipped Galvanized Metals CRS and HDG were coated with Composition A, as set forth in Example 1, Composition B, as set forth in Example 3, and Composition C. Composition C is a conventional zinc phosphate (non tri-cation) composition. Compositions A, B, and C were spray and dip coated onto CRS and HDG substrates and the properties of the resultant coatings were measured, as shown in Table 4.

TABLE 4

Comparison of Spray and Dip Coating Compositions A, B and C on Cold Rolled Steel and Hot Dipped Galvanized Metal Substrates

| Composition | Metal | Spray (S)/ Dip (D) | Free Acid | Ratio of Total Acid to Free Acid | DSGP (ppm) | Ct. Wt ($mg/ft^2$) | Crystal Size (microns) | Appearance |
|---|---|---|---|---|---|---|---|---|
| A | CRS | S | 0.8 | 15–20 | 65 | 150 | 2–5 | Uniform Gray |
| A | CRS | S | 1.0 | 15–20 | 65 | 161 | 2–4 | Uniform Gray |
| A | CRS | S | 1.2 | 15–20 | 65 | 167 | 2–3 | Uniform Gray |
| A | HDG | S | 0.8 | 15–20 | 65 | 150 | 1–2 | Uniform Gray |
| A | HDG | S | 1.0 | 15–20 | 65 | 150 | 1–2 | Uniform Gray |
| A | HDG | S | 1.2 | 15–20 | 65 | 168 | 1–2 | Uniform Gray |
| C | CRS | S | 1.0 | 15–20 | 0 | 170 | 15–25 | Uniform Gray |
| C | CRS | S | 1.0 | 15–20 | 65 | 220 | 24 | Uniform Gray |
| C | HDG | S | 1.0 | 15–20 | 0 | 290 | 10-20 | Uniform Gray |
| C | HDG | S | 1.0 | 15–20 | 65 | 335 | <10 | Uniform Gray |

TABLE 4-continued

Comparison of Spray and Dip Coating Compositions A, B and C on Cold Rolled Steel and Hot Dipped Galvanized Metal Substrates

| Composition | Metal | Spray (S)/ Dip (D) | Free Acid | Ratio of Total Acid to Free Acid | DSGP (ppm) | Ct. Wt ($mg/ft^2$) | Crystal Size (microns) | Appearance |
|---|---|---|---|---|---|---|---|---|
| B | CRS | S | — | — | 0 | 200 | 2–5 | Uniform Gray |
| B | HDG | S | — | — | 0 | 300 | 10–25 | Dark-spangle visible |
| A | CRS | D | 0.8 | 18–23 | 65 | 192 | 2–5 | Uniform Gray |
| A | CRS | D | 1.0 | 18–23 | 65 | 200 | 2–5 | Uniform Gray |
| A | CRS | D | 1.2 | 18–23 | 65 | 259 | 2–3 | Uniform Gray |
| A | HDG | D | 0.8 | 18–23 | 65 | 222 | 1–2 | Uniform Gray |
| A | HDG | D | 1.0 | 18–23 | 65 | 230 | 1–2 | Uniform Gray |
| A | HDG | D | 1.2 | 18–23 | 65 | 241 | 1–2 | Uniform Gray |
| B | CRS | D | — | — | 0 | 277 | 4–6 | Uniform Gray |
| B | HDG | D | — | — | 0 | 334 | 10 | Dark-spangle visible |

As shown in Table 4, tri-cation composition B, which did not include DSGP, exhibited an undesirably wide range of coating weights obtained between CRS and HDG and an undesirably high coating weight on average. Further, Composition C, a conventional coating which included DSGP, exhibited improved crystal size but also showed an undesirably wide range of coating weights and an undesirably high coating weight on average.

Only Inventive Composition A exhibited a desirably narrow range of coating weights, a lower coating weight on average, and a relatively smaller crystal size. Additionally, Composition A coatings, particularly on HDG, were uniformly gray. By contrast, comparative Composition B coatings were dark and had larger crystals with visible spangles on HDG, which are likely to undesirably affect paint glass and general aesthetic appearance. Accordingly, it can be seen that compositions of the present invention, as illustrated by Composition A, exhibit improved coating to metal surfaces as compared to conventional zinc phosphate compositions as well as tri-cation compositions which do not contain DSGP.

The examples set forth above serve to illustrate the present invention, but in no way are intended to limit the scope thereof, which is defined by the following claims.

What is claimed is:

1. A coating composition for metal substrates, comprising:

a) a tri-cationic phosphate composition which includes a phosphate component and ions of nickel, manganese, and zinc; and b) a glycerophosphate compound, wherein said composition is capable of providing anti-corrosion properties to metal substrates when applied thereto, and said zinc ions are present in an amount of 2000 parts per million or less.

2. The coating composition of claim 1, wherein said glycerophosphate compound is disodium glycerophosphate.

3. The coating composition of claim 1, wherein said glycerophosphate compound causes crystals of said composition to be formed in a substantially uniform manner on said metal substrates.

4. The coating composition of claim 1, further comprising a compound which includes a silicon component.

5. The coating composition of claim 4, wherein said silicon component is present in an amount of about 50 parts per million to an amount of about 300 parts per million.

6. The coating composition of claim 4, wherein said silicon component is present in an amount of about 100 parts per million of said composition.

7. The coating composition of claim 4, wherein said silicon component is provided by a compound selected from the group consisting of: hydrofluorosilicic acid; silicic acid; silicon dioxide; salts and combinations thereof.

8. The coating composition of claim 1, further comprising ions of fluoride.

9. The coating composition of claim 8, wherein said ions of fluoride are present in an amount of about 100 parts per million to an amount of about 1500 parts per million.

10. The coating composition of claim 8, wherein said ions of fluoride are present in an amount of about 250 parts per million of said composition.

11. The coating composition of claim 8, wherein said ions of fluoride are provided by a compound selected from the group consisting of: hydrofluoric acid; hydrofluorosilicic acid; hydrofluorotitanic acid; fluoroboric acid; salts and combinations thereof.

12. The coating composition of claim 1, wherein said phosphate component is present in an amount of about 8000 parts per million to about 30,000 parts per million.

13. The coating composition of claim 1, wherein said phosphate component is present in an amount of about 16000 parts per million of said composition.

14. The coating composition of claim 1, wherein said nickel ions are present in an amount of about 100 parts per million to about 1000 parts per million.

15. The coating composition of claim 1, wherein said nickel ions are present in an amount of about 800 parts per million of said composition.

16. The coating composition of claim 1, wherein said manganese ions are present in an amount of about 100 parts per million to about 1000 parts per million.

17. The coating composition of claim 1, wherein said manganese ions are present in a concentration of about 800 parts per million of said composition.

18. The coating composition of claim 1, wherein said zinc ions are present in an amount of about 500 parts per million to 2000 parts per million.

19. The coating composition of claim 1, wherein said zinc ion is present in a concentration of about 1000 parts per million of said composition.

20. The coating composition of claim 1, wherein said glycerophosphate compound is present in an amount of about 10 parts per million to about 500 parts per million.

21. The coating composition of claim 1, wherein said glycerophosphate compound is present in a concentration of about 65 parts per million of said concentration.

22. The coating composition of claim 1, wherein said coating is formed from crystals of about 2 to about 3 microns in size.

23. The coating composition of claim 1, wherein said phosphate component is provided by a compound selected from the group consisting of: phosphoric acid; alkali metal phosphates such as monosodium phosphate, monopotassium phosphate, disodium phosphate; divalent metal phosphates; zinc phosphate; zinc monohydrogen phosphate; zinc dihydrogen phosphate; manganese phosphate; manganese monohydrogen phosphate; manganese dihydrogen phosphate; and combinations thereof.

24. The coating composition of claim 1, wherein said zinc ions are provided by a compound selected from the group consisting of: zinc; zinc nitrate; zinc oxide; zinc carbonate; zinc phosphate; and combinations thereof.

25. The coating composition of claim 1, wherein said nickel ions are provided by a compound selected from the group consisting of: nickel carbonate; nickel nitrate; nickel phosphate; and combinations thereof.

26. The coating composition of claim 1, wherein said manganese ions are provided by a compound selected from the group consisting of: manganese carbonate; manganese nitrate; manganese phosphates; and combinations thereof.

27. A method of improving the anti-corrosion properties of metal substrates, comprising the steps of:

a) providing a coating composition, said coating composition comprising phosphate ions, nickel ions, manganese ions, zinc ions, and disodium glycerophosphate; and b) coating a metal substrate with said coating composition wherein said zinc ions are present in an amount of 2000 parts per million or less.

28. A method according to claim 27, wherein said metal substrate is cold rolled steel or hot dipped galvanized metal.

29. A method according to claim 27, wherein said coating composition further comprises a compound which includes a silicon component.

30. A method according to claim 29, wherein said silicon component is present in an amount of about 50 parts per million to an amount of about 300 parts per million.

31. A method according to claim 29, wherein said silicon component is present in a concentration of about 100 parts per million of said composition.

32. A method according to claim 27, wherein said coating composition further comprises ions of fluoride.

33. A method according to claim 32, wherein said ions of fluoride are present in an amount of about 100 parts per million to an amount of about 1500 parts per million.

34. A method according to claim 32, wherein said ions of fluoride are present in a concentration of about 250 parts per million of said composition.

35. A method according to claim 27, further comprising the step of activating said metal substrate with an activating agent.

36. A method according to claim 35, wherein said activating agent is a titanium compound.

37. A method according to claim 27, wherein said coating step includes immersing said metal substrate in said coating composition.

38. A method according to claim 27, wherein said coating step includes spraying said coating composition onto one or more surfaces of said metal substrate.

39. A method according to claim 27, further comprising the step of painting said metal substrate subsequent to said coating step.

40. A method according to claim 39, wherein said painting step comprises the application of an electropaint compound to said metal substrate.

41. The coating composition of claim 1, wherein said composition provides a uniform coating weight on said metal substrates.

* * * * *